US006994021B2

(12) United States Patent
Krammer

(10) Patent No.: US 6,994,021 B2
(45) Date of Patent: Feb. 7, 2006

(54) PRESS FOR THE EXPRESSING OF LIQUID-CONTAINING SUBSTANCES

(75) Inventor: Volker Krammer, Weinheim (DE)

(73) Assignee: Willmes Anlagentechnik GmbH, Lampertheim (DE)

( * ) Notice: Subject to any disclaimer, the term of this patent is extended or adjusted under 35 U.S.C. 154(b) by 0 days.

(21) Appl. No.: 10/826,552

(22) Filed: Apr. 16, 2004

(65) Prior Publication Data

US 2004/0194645 A1 Oct. 7, 2004

Related U.S. Application Data

(63) Continuation of application No. PCT/EP02/11670, filed on Oct. 18, 2002.

(30) Foreign Application Priority Data

Oct. 24, 2001 (DE) ..... 201 17 227 U

(51) Int. Cl.
*B30B 9/22* (2006.01)

(52) U.S. Cl. ..... 100/107; 100/114; 100/116; 100/126; 100/211

(58) Field of Classification Search ..... 100/104, 100/107, 108, 109, 110, 114, 116, 126, 211; 210/350; 285/364, 408
See application file for complete search history.

(56) References Cited

U.S. PATENT DOCUMENTS 3,951,058 A * 4/1976 Hauser ..... 100/107
4,475,451 A * 10/1984 Hartmann ..... 100/107
5,752,438 A * 5/1998 Hartmann et al. ..... 100/107

FOREIGN PATENT DOCUMENTS

| | | |
|---|---|---|
| EP | 0 145 948 B1 | 6/1985 |
| EP | 0 585 596 A1 | 3/1994 |
| WO | 01/76857 A1 | 10/2001 |

* cited by examiner

*Primary Examiner*—Derris H. Banks
*Assistant Examiner*—Jimmy T. Nguyen
(74) *Attorney, Agent, or Firm*—Laurence A. Greenberg; Werner H. Stemer; Ralph E. Locher

(57) ABSTRACT

A press for pressing out substances containing liquids, especially agricultural and chemical products, includes a closed container whose inner area is divided by at least one press membrane into a pressure medium chamber and a pressing medium chamber. A fill/discharge opening, sealable by a lid, is disposed in the casing and is associated with a juice run-off located in the pressing medium chamber. Flexible or elastic liquid-permeable drainage elements are also disposed in the inner area of the container for removing juice. The drainage elements include at least one support element and a flexible tube disposed therearound and are of a juice-permeable material. The drainage elements are configured as single-pieced components and are detachably received on the container by holding devices, which are disposed on both sides of the container, each drainage element being able to be removed as a component from the inner area of the container.

28 Claims, 6 Drawing Sheets

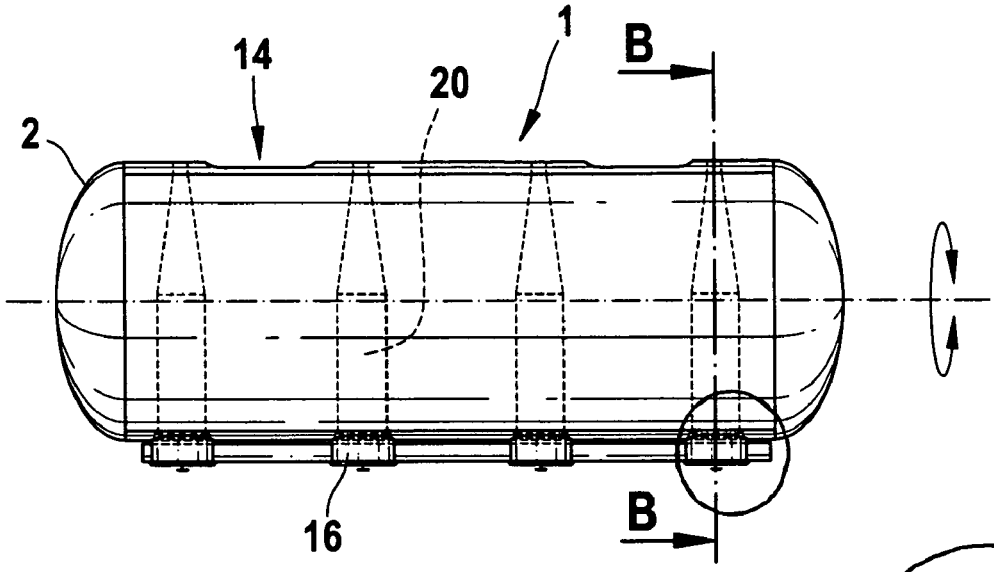
FIG. 2A
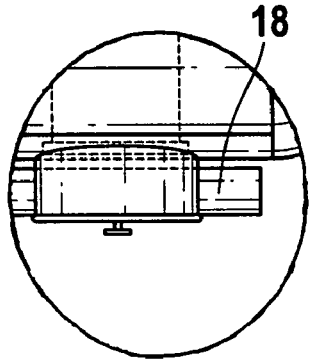
FIG. 2B
FIG. 3A
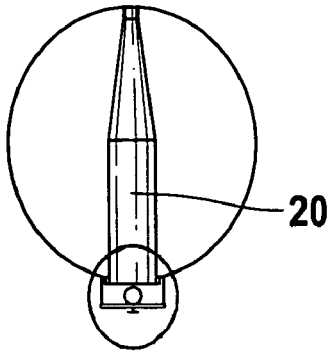
FIG. 3B
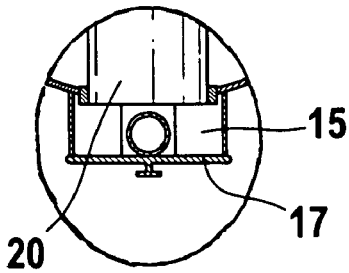

PRESS FOR THE EXPRESSING OF LIQUID-CONTAINING SUBSTANCES

CROSS-REFERENCE TO RELATED APPLICATION

This application is a continuation, under 35 U.S.C. § 120, of copending international application No. PCT/EP02/11670, filed Oct. 18, 2002, which designated the United States; this application also claims the priority, under 35 U.S.C. § 119, of German patent application No. 201 17 227.5, filed Oct. 24, 2001; the prior applications are herewith incorporated by reference in their entirety.

BACKGROUND OF THE INVENTION

Field of the Invention

The invention relates to a press for the expressing of liquid-containing substances, in particular, of agricultural and chemical products. The press has a closed container, at least one press diaphragm subdividing an interior of the container into a pressure medium space and a press medium space. The container casing has disposed in it a filling and emptying orifice that is capable of being closed by a cover and that is associated with a juice discharge located in the press medium space. Liquid-permeable flexible or elastic drainage elements are disposed in the container interior for large-volume juice extraction that include at least one supporting element and a hose disposed around the latter and being of juice-permeable material.

Such presses are known, for example, from European Patent 0 145 948 B1 and are used for expressing the grape juice used as the initial substance for wine production out of grapes introduced into the press. The press described in EP 0 145 948 B1 has a closed container that can be set in rotation about its horizontal longitudinal axis. Located in the casing of the container is a filling and emptying orifice that is disposed opposite a juice discharge provided on the opposite side of the container and that can be closed by a cover. Along the diametral region of the container, drainage elements in the form of liquid-permeable tubes are provided, which are located in a press space defined by a press diaphragm that is tight to pressure medium and is fastened inside the container and that subdivides the container interior into a pressure medium space and the press space.

Commonly assigned international application PCT/EP01/03962, published WO01/76857, describes a press that includes a closed container capable of being set in rotation about its horizontal longitudinal axis. The container interior is subdivided into a pressure medium space and a press medium space by at least one press diaphragm, and a filling and emptying orifice capable of being closed by disposing a cover in the container casing. The filling and emptying orifice has located opposite it a juice discharge located in the press space. Furthermore, the press space has disposed in it liquid-permeable drainage elements that are disposed over the diameter and substantially perpendicularly to the container axis and that extend from one end of the container to the other end of the container. The drainage elements are formed by an elastic or flexible supporting element, around which a juice-permeable fabric hose is disposed. In the juice extraction position, the drainage elements extend in a substantially vertical direction to feed the juice into a juice-collecting nipple that is located underneath and from which the juice is delivered to a collecting container through a collecting line.

In the presses described above, what is critically important is that the parts, in particular, the drainage elements, coming into contact with the batch during pressing can be demounted in a simple way for cleaning purposes and can be mounted within the container again after the cleaning operation. In such a case, it is particularly important that the demounting and, also, the cleaning of the drainage elements and of the container interior can take place from outside because the climbing of persons into the container entails an appreciable risk or is even forbidden by safety regulations.

In the presses described above, there is, in such a case, the problem that the drainage elements must withstand the pressures acting on them from outside so that a sufficient juice discharge is always ensured. Particularly where large presses are concerned, the problem in this case arises that the drainage elements, provided with metal reinforcing elements to increase strength, have a very high weight so that they can no longer be inserted in the interior of the container by only one operator.

SUMMARY OF THE INVENTION

It is accordingly an object of the invention to provide a press for the expressing of liquid-containing substances, in particular of agricultural and chemical products, that overcomes the hereinafore-mentioned disadvantages of the heretofore-known devices of this general type and in which, even when the press is a large press with a container diameter of, for example, two to three meters, the drainage elements can be extracted from the container and cleaned in a simple way by only one person.

With the foregoing and other objects in view, there is provided, in accordance with the invention, a press for expressing liquid-containing substances, including a closed container having a cover, a filling and emptying orifice selectively opened and closed by the cover, a casing defining an interior, and at least one press diaphragm disposed in the interior, the press diaphragm subdividing the interior into a pressure medium space and a press medium space, a juice discharge fluidically connected to the press medium space, drainage elements disposed in the interior of the casing for large-volume juice extraction, the drainage elements being liquid-permeable and at least one of flexible and elastic and having at least one supporting element, a hose disposed around the supporting element, the hose being of a juice-permeable material, two sides, and holding devices disposed at each of the two sides, the drainage elements being a unitary assembly or one-piece structural parts, and the holding devices removably and releasably securing the drainage elements at the container, the drainage elements being inserted into and removed from the interior of the container as a structural part.

With the objects of the invention in view, there is also provided a press for expressing liquid-containing substances, including a container having a filling and emptying orifice, a cover selectively opening and water-tightly closing the filling and emptying orifice, a water-tight casing defining an interior, and at least one press diaphragm disposed in the interior, the press diaphragm subdividing the interior into a pressure medium space and a press medium space, a juice discharge fluidically connected to the press medium space, drainage elements disposed in the interior, each being fluidically connected to the discharge, and each having at least one supporting element being at least one of flexible and elastic, a hose disposed around the supporting element, the hose being of a juice-permeable material, two sides, and at least one holding device disposed at each of the two sides and removably and releasably securing the drainage elements in the interior of the container, each of the drainage elements being inserted into and removed from the interior of the container in one-piece.

With the objects of the invention in view, there is also provided a press for expressing liquid-containing substances, including a closed container having a cover, a filling and emptying orifice selectively opened and closed by the cover, a casing defining an interior, and at least one press diaphragm disposed in the interior, the press diaphragm subdividing the interior into a pressure medium space and a press medium space, a juice discharge associated with the filling and emptying orifice, drainage elements disposed in the interior of the casing for large-volume juice extraction, the drainage elements being liquid-permeable and at least one of flexible and elastic and having at least one supporting element, a hose disposed around the supporting element, the hose being of a juice-permeable material, two sides, and holding devices disposed at each of the two sides, the drainage elements being a unitary assembly or one-piece structural parts, and the holding devices removably and releasably securing the drainage elements at the container, the drainage elements being inserted into and removed from the interior of the container as a structural part.

In accordance with another feature of the invention, the hose has ends and a peripheral bead at each of the ends, the bead cooperating with an associated one of the holding devices, the holding devices being fastened to the container through the bead.

In accordance with an added feature of the invention, the hose has ends and a peripheral bead at each of the ends, the bead cooperating with an associated one of the holding devices, the ends being fastened to the container through the bead.

In accordance with an additional feature of the invention, the interior of the container has a diameter and the drainage elements have a length greater than the diameter of the interior of the container.

In accordance with yet another feature of the invention, the hose has a length and a slide fastener running over an entirety of the length.

In accordance with yet a further feature of the invention, the interior of the container has an inner wall and the holding devices are mounted on the inner wall.

In accordance with yet an added feature of the invention, the holding devices have clamping pieces disposed at ends of the supporting element and clamping flanges selectively connected to the container and the beads of the hose are clamped between the clamping flanges.

In accordance with yet an additional feature of the invention, there are provided holding flanges fastened to the interior of the container, the container having a juice discharge side, and at least one of the clamping flanges and at least one of the holding flanges at the juice discharge side having a bayonet connector and being respectively connected to one another with the bayonet connector. Preferably, the holding flanges have a substantially circular shape. In particular, the holding flanges and the clamping flanges each have a substantially circular shape.

In accordance with again another feature of the invention, the container has a longitudinal axis, holding flanges are fastened to the interior of the container, the container has a juice discharge side, at least one of the clamping flanges at a side of the container approximately opposite the juice discharge side has an approximately oval shape with a longer axis and a shorter axis, and when the drainage elements are inserted in the container, the shorter axis runs substantially parallel to the longitudinal axis of the container.

In accordance with again a further feature of the invention, the clamping flanges and at least one of the holding flanges at the opposite side each have an approximately oval shape, and at least one of the clamping flanges and at least one of the holding flanges at the opposite side have a bayonet connector and are respectively connected to one another with the bayonet connector.

In accordance with again an added feature of the invention, the supporting element is at least one of an elastic supporting element and a flexible supporting element.

In accordance with again an additional feature of the invention, the supporting element is at least two flexible supporting hoses, in particular, fastened to the clamping pieces.

In accordance with still another feature of the invention, the supporting hoses are connected to the clamping pieces through crimped connections.

In accordance with still a further feature of the invention, the flexible supporting element is at least one rigid subelement fastened to the container through holding devices in the form of flexible connecting elements.

In accordance with still an added feature of the invention, the supporting element is rigid, preferably, a bar or a rod. The supporting element can have a grooved and/or corrugated surface. The supporting element can be at least one of chain links and lined-up balls. Further, he supporting element can have a rectangular or square cross-section.

In accordance with still an additional feature of the invention, the container rotates about a horizontal axis.

In accordance with another feature of the invention, the drainage elements are disposed over a diameter of the container and are substantially perpendicularly to a longitudinal axis of the container.

In accordance with a further feature of the invention, the container has a juice-extraction position and the drainage elements are disposed substantially vertically in the juice extraction position.

In accordance with an added feature of the invention, the juice discharge is opposite the filling and emptying orifice.

In accordance with an additional feature of the invention, the juice-permeable hose is of fabric.

In accordance with yet another feature of the invention, the juice-permeable hose is one of a wound spiral and netting.

In accordance with yet a further feature of the invention, the container is at least one of an agricultural product container and a chemical product container.

In accordance with a concomitant feature of the invention, the drainage elements are fluidically connected to the discharge.

The press according to the invention has the advantage that, where the pressing of grapes is concerned, the juice can be expressed from the crush with very high efficiency. This, in turn, affords the advantage that the pressures of the pressure medium that act upon the pressure medium space on that side of the press diaphragm facing away from the batch, can be kept relatively low. As a result, the turbidities likewise emerging from the grapes under high expressing pressures do not also pass into the grape juice, thus affording a considerable gain in quality of the grape juice.

Furthermore, due to the increased efficiency of the press according to the invention, the expressing of the grapes can take place within a substantially shorter time, as compared with known presses of the prior art, thus leading to an increased batch throughput in the press according to the invention.

Moreover, the flexibility of the juice ducts according to the invention in large-volume juice extraction by a press diaphragm leads, advantageously, to the press diaphragms being exposed to considerably lower loads than is the case in the prior art because the drainage element no longer constitutes a fixed obstacle from which the press diaphragm has to move aside or against which the press diaphragm may chafe. This applies both in the horizontal direction, in which the drainage element, by virtue of its flexibility, can move aside within the batch according to the pressure conditions, and in the vertical direction, in which the press diaphragm approaching the drainage element from both sides can, because of the overlength and/or elasticity of the elastic fabric material, grip the fabric hose or the entire drainage element and drive it in the vertical direction. In other words, due to the possibility of the upward and downward movement of the drainage element because of its flexible construction or to the likewise conceivable use of one or more elastic intermediate pieces in the case of a partially stiffly or rigidly configured drainage element, no friction arises between the press diaphragm and the fabric hose. As a result, the wear, brought about thereby, of the only slightly stretchable diaphragm is eliminated virtually completely.

A further advantage associated with the flexible construction according to the invention of the drainage elements is to be seen in that the filling volume of the container with batch is utilized considerably more effectively during the filling of the container, for example, by one or more filling covers, because the flexible drainage elements, preferably, also configured with overlength, do not present a rigid central obstacle to the follow-up of the batch. As a result, the batch can reach even the container regions not lying in the vicinity of the covers, thus, leading to an increase in the filling quantity.

A further increase in the filling volume is obtained in that the volume of the flexible drainage elements according to the invention in the case of large-volume juice extraction is smaller than the filling volume of rigid drainage elements, such as are used in presses of the prior art. Thus, the container volume available to the batch is larger. This is attributable to the fact that a rigid drainage element is subjected predominantly to bending and compressive loads, whereas a flexible drainage element is subject solely to tensile loads. In order, in the rigid drainage elements of the prior art, to counteract the bending and compressive loads to prevent damage, the respective geometric moments of inertia in these have to be increased, this, as a rule, entailing an enlargement of the cross-section that, in turn, leads to a larger volume of the respective rigid drainage element.

A further advantage afforded by the use of the flexible drainage elements according to the invention is that, during the loosening of the batch, for which purpose the container is rotated, preferably, about its longitudinal axis, the flexibility of each drainage element during each movement of the container leads to possibly adhering batch being shaken off. The removal arises due to the fact that the surface of the drainage elements, that is to say, the base to which the batch adheres, likewise varies both its position and its surface configuration during a rotation of the container. As a consequence, the adhering batch automatically comes loose from the drainage elements without any external action. By contrast, a rigid drainage element does not have such a self-cleaning effect.

Other features that are considered as characteristic for the invention are set forth in the appended claims.

Although the invention is illustrated and described herein as embodied in a press for the expressing of liquid-containing substances, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 2A is a diagrammatic, partially hidden and elevational side view of the press of FIG. 1 illustrating the juice-collecting nipple with the drainage element disposed thereabove;

FIG. 2B is an enlarged partially hidden and elevational side view of the juice-collecting nipple of FIG. 2B;

FIG. 3A is a diagrammatic cross-sectional view of the press of FIG. 2A along section line 3A—3A;

FIG. 3B is an enlarged cross-sectional view of a portion of the press of FIG. 3A;

DESCRIPTION OF THE PREFERRED EMBODIMENTS

Figure 1A:
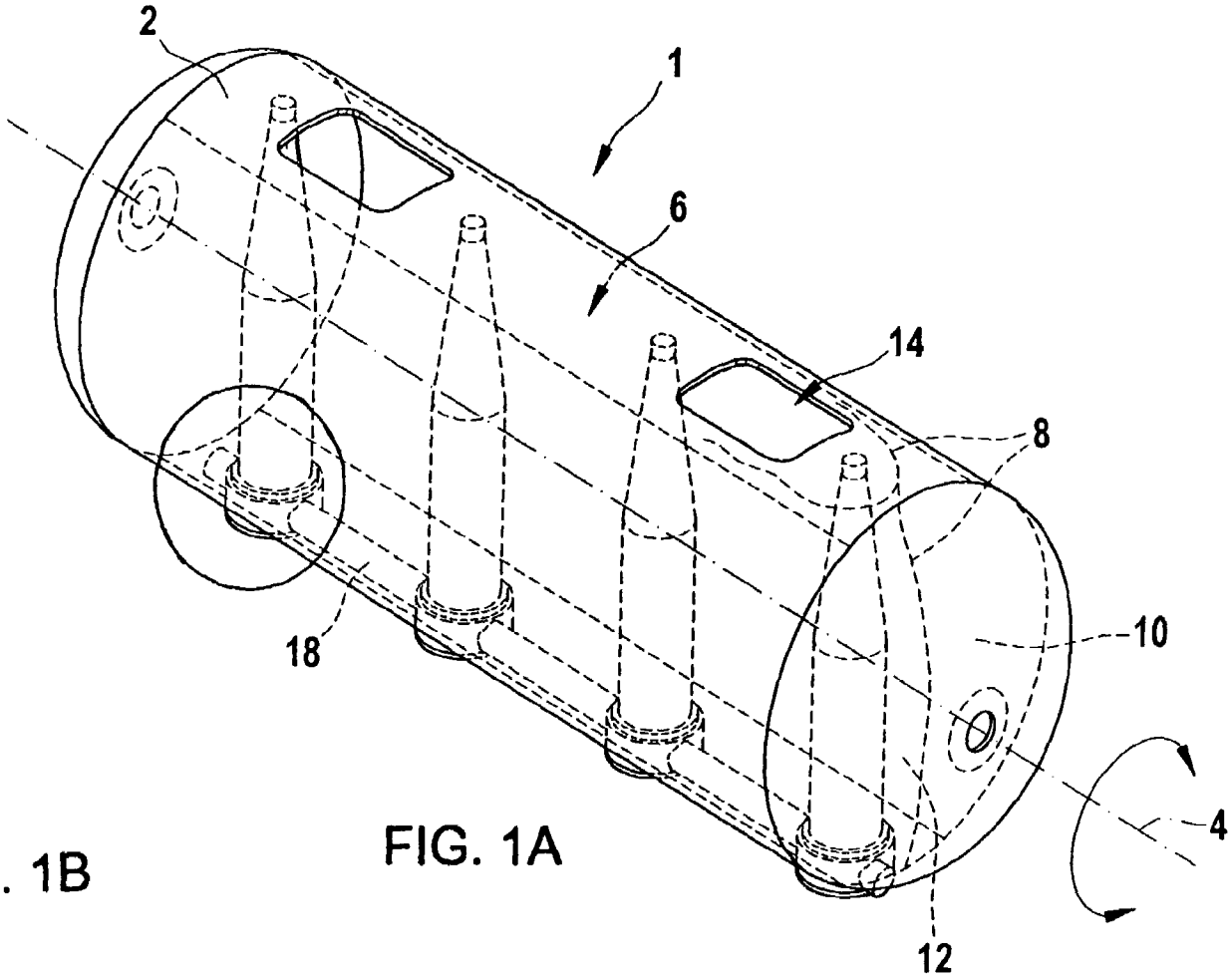
FIG. 1A is a diagrammatic, partially hidden and perspective view of a press according to the invention.
Figure 1B:
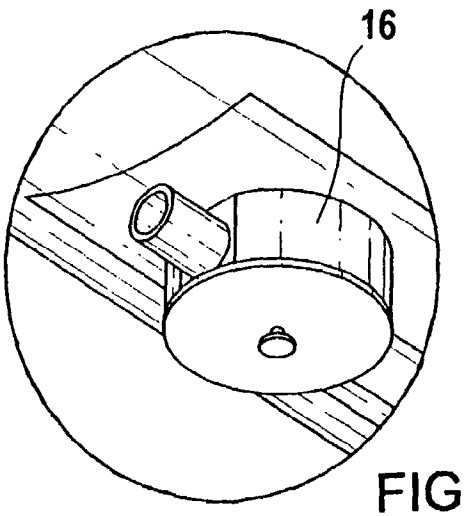
FIG. 1B is an enlarged perspective view of a collecting nipple for the disposed on an underside of the press of FIG. 1A.

Referring now to the figures of the drawings in detail and first, particularly to FIGS. 1A, 1B, 2A, and 2B thereof, there is shown a press 1 according to the invention including an elongate cylindrical container 2 that can be rotated about a container longitudinal axis 4 through non-illustrated drive devices. It is, likewise, possible, however, in the same way, for the container 2 to have a shape differing from the cylindrical shape and to be able to be rotated about an axis other than the longitudinal axis 4 illustrated in FIGS. 1A, 1B, 2A, and 2B, for example, about an axis running in the horizontal direction or in the vertical direction perpendicularly to the longitudinal axis 4. Within the container interior 6 is disposed a press diaphragm 8, indicted merely diagrammatically for illustrative reasons, which subdivides the container interior 6 into a pressure medium space 10 and a press medium space 12.

The batch, for example, grapes, is introduced into the press medium space 12 through one or more filling and emptying orifices 14, and, after the closing of the orifices 14 by non-illustrated covers, the pressure medium space 10 is acted upon, between the inner wall of the container 2 and the diaphragm 8, by a pressure medium, for example, by compressed air that may have a pressure of, for example, 1.2 to 2 bar.

Located on the side of the container 2 that is opposite the closeable filling and emptying orifice 14 is a, preferably, nipple-like juice discharge 16 that is disposed on the underside of the container 2 during the expressing operation as a result of rotation of the container into a corresponding position. In such a case, preferably, a plurality of juice discharges 16 are disposed along the longitudinal axis 4 of the container 2 and are connected to one another by a connecting line 18, through which the expressed grape juice is fed to a non-illustrated collecting container for further processing.

As may also be gathered from FIGS. 1A, 1B, 2A, and 2B, a plurality of flexible or elastic drainage elements 20 are located within the container 2, which, according to the figures, are disposed above the juice discharges 16 during the expressing operation and extend substantially perpendicularly to the longitudinal axis 4 diametrally.

According to the illustration in FIG. 4, the drainage elements 20 include an elastic or flexible supporting element 22 and a juice-permeable hose 24 disposed around the flexible supporting element 22. The hose 24 is, preferably, of a flexible or elastic fabric, for example, of a multiply nylon fabric that has a mesh width of, preferably, less than one millimeter and that is suitable for guiding the grape juice through the fabric into the region of the supporting elements 22, but, on the other hand, for keeping the particles contained in the batch away from the region of the supporting elements 22.

It is likewise possible, however, to manufacture the hose 24 from a wound spiral or from netting, in particular, of metal, or to produce the hose from a nonwoven material. For a clearer understanding, however, the hose 24 is designated below as a fabric hose 24.

As can also be gathered from FIG. 4A, the juice-permeable fabric hose 24 is, preferably, provided with a slide fastener 26 that runs in the longitudinal direction of the drainage element 20 such that, with the slide fastener open, the fabric hose 24 can be laid around the supporting elements 22 and, after the slide fastener 26 is, subsequently, closed, surrounds the supporting elements 22 completely.

Figures 4A, 4B:
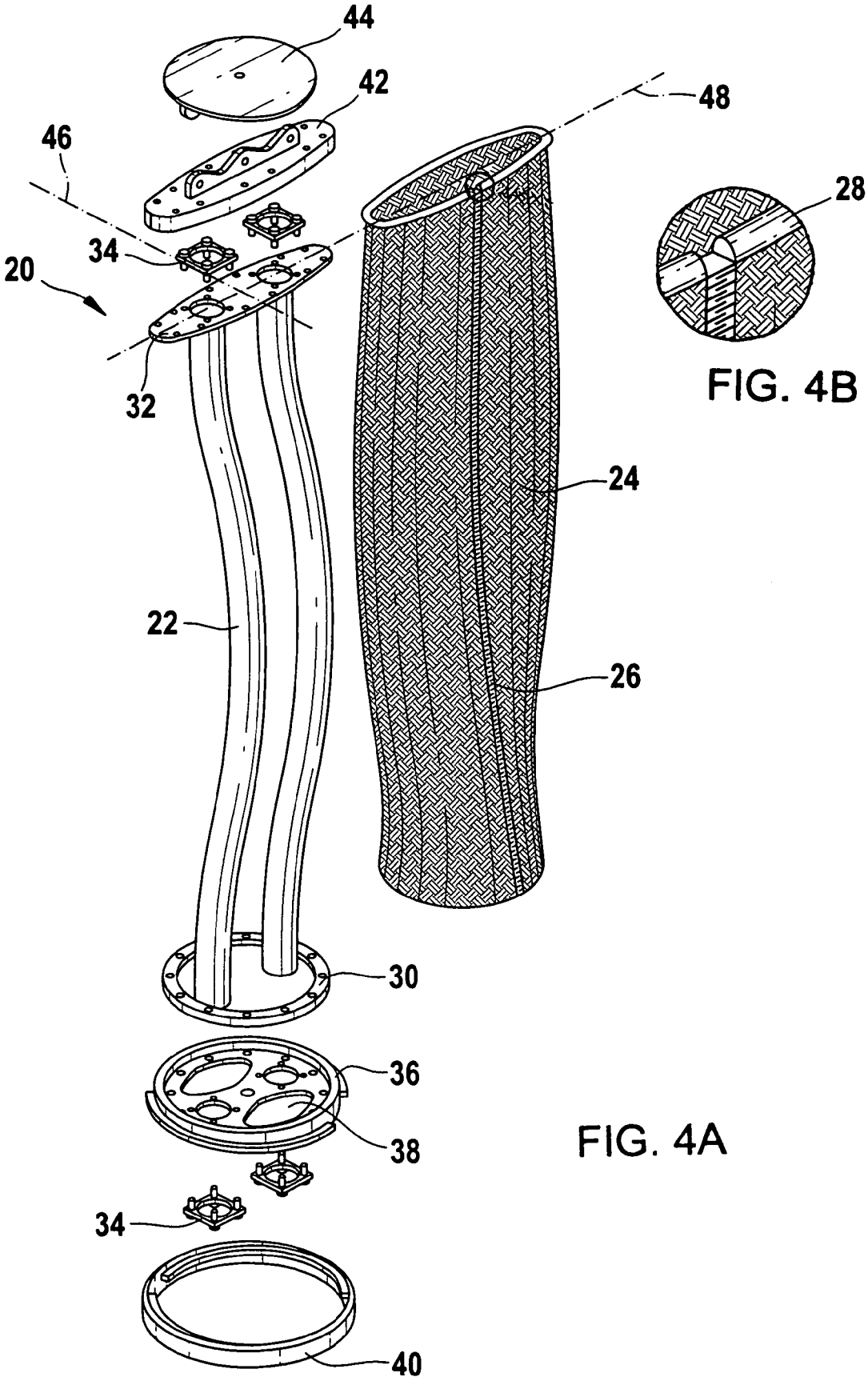
FIG. 4A is a diagrammatic exploded view of a drainage element according to the invention used in the press of FIGS. 1 to 3B.
FIG. 4B is an enlarged perspective view of a portion of the drainage element of FIG. 4A.
Figure 5:
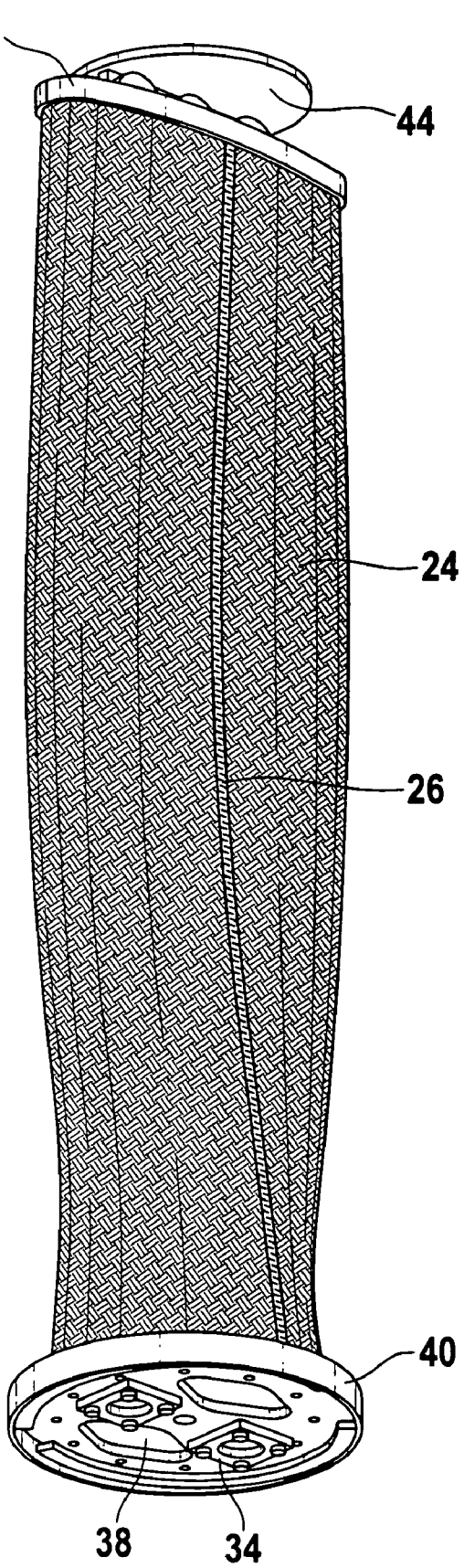
FIG. 5 is a diagrammatic perspective view of the drainage element of FIG. 4A in an assembled state with a closed slide fastener.
Figure 6:
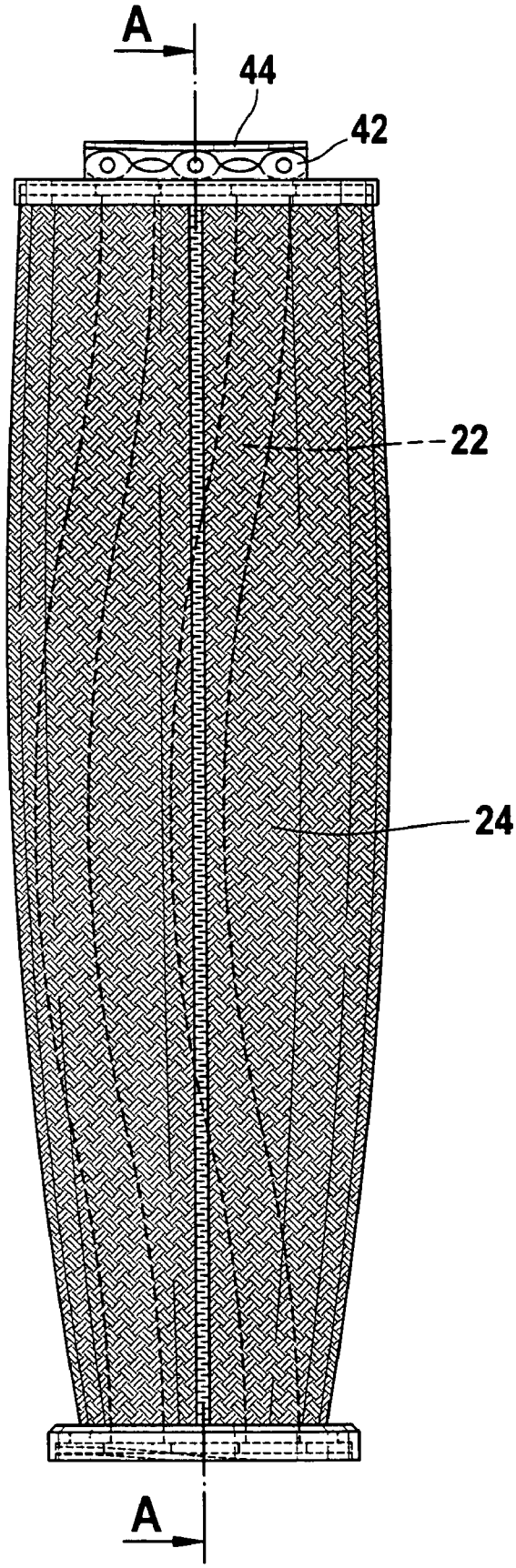
FIG. 6 is a diagrammatic partially hidden and side elevational view of the drainage element of FIG. 5.

In the preferred embodiment of the invention, the juice-permeable fabric hose 24 is provided at each of its ends with a peripheral bead 28 (as shown in FIG. 4B) that serves for fastening the ends of the fabric hose 24 to the inside of the container interior with the aid of associated holding devices described in more detail below.

The drainage elements 20, preferably, have a length that is somewhat greater than the diameter of the container interior 6. Such a configuration affords the advantage that the drainage elements 20 and, in particular, the supporting elements 22 contained therein, can, because of their flexibility, adapt to the different pressure conditions within the batch, that is to say, the crush, during the pressing operation.

In such a case, the fastening of the drainage elements 20 takes place, according to the invention, with the aid of holding devices so that the drainage elements 20, which are extremely light by virtue of their construction, even in the case of very large containers 2, and which are composed of the interconnected fabric hoses 24 and of the supporting elements 22 disposed within the fabric hoses 24 and fastened to these, can be extracted as a structural part from the interior 6 of the container 2.

Figure 7A:
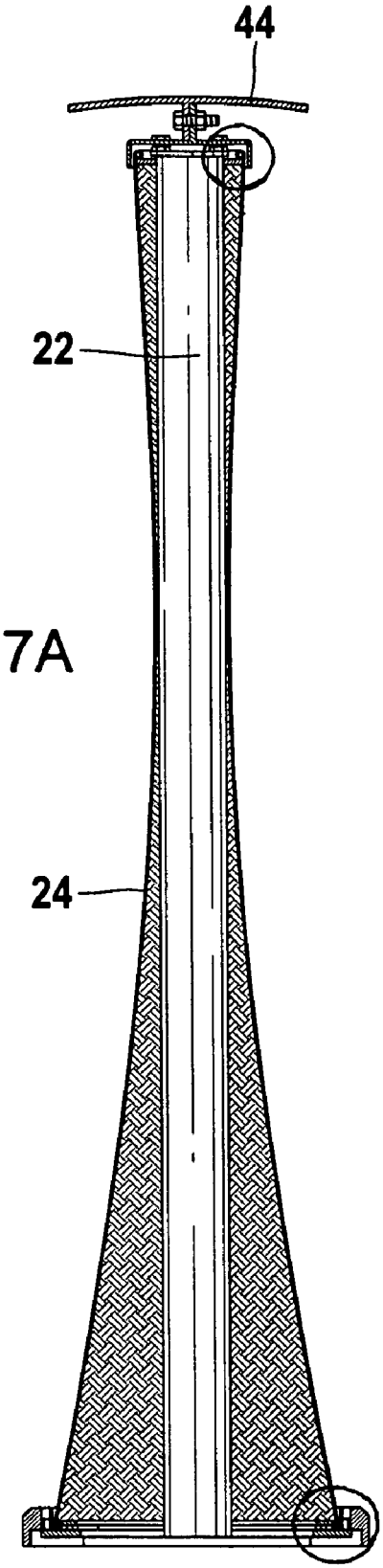
FIG. 7A is a diagrammatic cross-sectional view of the drainage element of FIG. 6 along section line 7A–7; A, with enlarged illustrations of the holding devices for fastening the juice-permeable fabric hose.
Figure 7B:
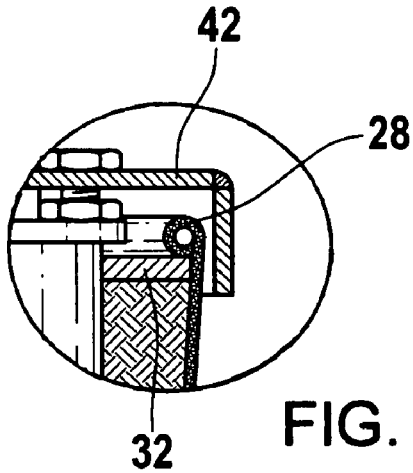
FIG. 7B is an enlarged diagrammatic cross-sectional view of a portion of a holding device for fastening the juice-permeable fabric hose of FIG. 7A.
Figure 7C:
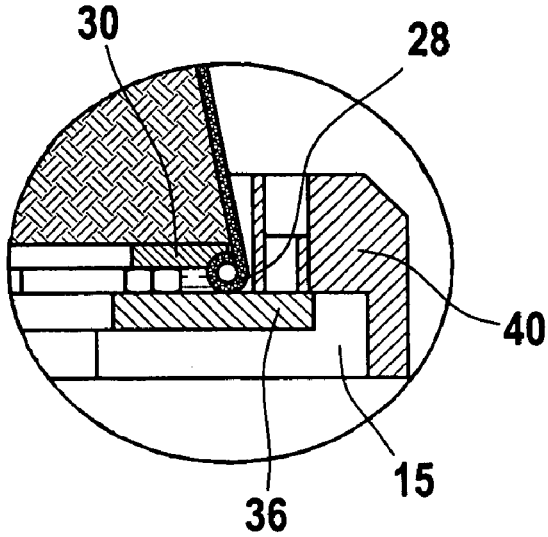
FIG. 7C is an enlarged diagrammatic cross-sectional view of a portion of a holding device for fastening the juice-permeable fabric hose of FIG. 7A.

As may be gathered, furthermore, from the exploded illustrations of FIG. 4B and FIGS. 7B and 7C, the holding devices are formed, on sides of the drainage elements 20, by clamping pieces 30, 32, to which the supporting elements 22 constructed as supporting hoses are fastened with the aid of crimped screw connections 34 known per se.

The clamping piece 30 located on the juice outlet side is, in this case, preferably, circular and cooperates with an associated clamping flange 36, by which it is screwed, after the insertion of the bead 28 of the fabric hose 24 between the clamping piece 30 and an associated clamping flange 36, to the end located on the juice discharge side so as to form a liquid-tight connection. Within the clamping flange 36 are formed juice outlet orifices 38 that divert the grape juice pressed through the fabric of the fabric hose 24 toward the juice discharge 16.

In the preferred embodiment of the invention, the clamping flange 36 at the end of the drainage element 20 that is located on the juice outlet side cooperates with a holding flange 40 that is fastened to the casing surface of the container 2, preferably, by welding, but which may also be fastened in another way.

On the container side located opposite the juice discharge 16, the fastening of the drainage element 20 takes place in a similar way, according to the illustration of FIG. 4A and to the illustration of the detail in FIGS. 7B and 7C, with the aid of the clamping piece 32 that is screwed to an associated clamping flange 42 and with the aid of non-illustrated screws, the peripheral bead 28 of the fabric hose 24 being clamped between the clamping piece 32 and the clamping flange 42 such that a passage of juice from the batch is ruled out. The clamping flange 42 is connected to a cover 44 that is fastened releasably to the container 2 on the side of the container 2 that is located opposite the juice discharge 16.

By configuring the drainage elements 20 according to the invention, the elements 20 can, even in the case of very large containers 2, be removed as a structural part from the interior of the container 2 in the shortest possible time for cleaning purposes or for the purpose of repair and, due to the configuration of the fabric hose 24 with a slide fastener 26, not only does a highly cost-effective production of the fabric hose become possible, but also a damaged fabric hose 24 can be exchanged in the shortest possible time for a new fabric hose 24 or for a fabric hose 24 with a fabric having another mesh width.

The insertion and removal of the drainage elements 20 in this case, preferably, take place through removal orifices 15 which, according to the illustration of FIGS. 3A and 3B, are formed in the region of the nipple-like juice discharges 16 and that are closed by covers 17, illustrated diagrammatically. In such a case, the holding flanges 40 and the associated clamping flanges 36 form a bayonet fastening such that the circular clamping flanges 36, by being rotated, can be brought into engagement with the holding flanges 40 associated with them, in order, for example, to fasten to the container 2 the drainage element 20 introduced from outside as one part through the orifice 17 into the container 2.

As may be gathered, furthermore, from FIGS. 4A to 7C, the clamping piece 32 on the side of the container 2 that is located opposite the juice discharge 16 is, preferably, oval and has a shorter axis 46 and a longer axis 48. In this embodiment of the invention, the drainage element 20 is disposed and oriented, in the region of the end of the container 2 that is located opposite the juice discharge 16, preferably, such that the shorter axis 46 extends substantially parallel to the longitudinal axis 4 of the container 2. Such a configuration affords the advantage that a higher efficiency is achieved during the expressing of the batch, in which the drainage elements 20 are disposed substantially vertically, and, moreover, the tensile and shearing forces that act on the press diaphragm 8 and that may lead to high loads upon or even damage to the press diaphragm 8 are, as far as possible, eliminated.

The supporting elements 22, which, in the above-described embodiment of the invention, are formed, preferably, by flexible plastic or rubber hoses, may, furthermore, be provided on their outer surface with a corrugated or spiral grooving that runs along each hose and, when the fabric of the fabric hose 24 is pressed onto the surface of the supporting hoses, leads to a multiplicity of interspaces, through which the juice can be diverted in the direction of the juice outlet orifices 38.

In the same way, there is the possibility of constructing the supporting elements 22 as chains or lined-up balls running along the drainage elements 20 or as plates or strips of hollow or solid material with a rectangular or square cross-section, thus allowing a similarly good discharge of juice.

Furthermore, it is likewise possible that the flexible supporting elements 22 according to the invention include a rigid, for example, bar-shaped or strip-shaped, sub-element that is fastened to the container 2 through holding devices in the form of flexible connecting elements. In such an embodiment of the invention, however, it is likewise conceivable to connect a plurality of such rigid portions to one another in each case by flexible connecting elements.

Finally, there is the possibility of configuring the supporting elements 22 rigidly, overall, for example, by the use of one or more metal bars or tubes, instead of the flexible plastic hoses that are surrounded by the juice-permeable flexible or elastic fabric hoses 24.

I claim:

1. A press for expressing liquid-containing substances, comprising:

a closed container having:

a cover;

a filling and emptying orifice selectively opened and closed by said cover;

a casing defining an interior; and at least one press diaphragm disposed in said interior;

said press diaphragm subdividing said interior into a pressure medium space and a press medium space;

a juice discharge fluidically connected to said press medium space;

drainage elements disposed in said interior of said casing for juice extraction, said drainage elements being liquid-permeable and at least one of flexible and elastic and each of said drainage elements having:

at least one supporting element;

a hose disposed around said supporting element, said hose being of a juice-permeable material and having opposing ends; and holding devices disposed at each of said ends of said hose;

said drainage elements being a unitary assembly; and said holding devices removably and releasably securing said drainage elements to holding flanges disposed at said container, said drainage elements being inserted into and removed from said interior of said container as a structural part.

2. The press according to claim 1, wherein said hose has:

a peripheral bead at each of said ends, said bead cooperating with an associated one of said holding devices, said hose being fastened to said container through said bead.

3. The press according to claim 1, wherein said hose has:

a peripheral bead at each of said ends, said bead cooperating with an associated one of said holding devices, said ends being fastened to said container through said holding devices.

4. The press according to claim 1, wherein:

said interior of said container has a diameter; and said drainage elements have a length greater than said diameter of said interior of said container.

5. The press according to claim 1, wherein said hose has a length and a slide fastener running over an entirety of said length.

6. The press according to claim 1, wherein:

said interior of said container has an inner wall; and said holding devices are mounted on said inner wall.

7. The press according to claim 2, wherein:

said holding devices have:

clamping pieces disposed at ends of said supporting element; and clamping flanges selectively connected to said container; and said beads of said hose are clamped between said clamping flanges.

8. The press according to claim 7, wherein:

said interior of said container has an inner wall; and said holding devices are mounted on said inner wall.

9. The press according to claim 7, further comprising:

said holding flanges fastened to said interior of said container;

said container having a juice discharge side; and at least one of said clamping flanges and at least one of said holding flanges at said juice discharge side having a bayonet connector and being respectively connected to one another with said bayonet connector.

10. The press according to claim 9, wherein said holding flanges have a substantially circular shape.

11. The press according to claim 9, wherein said holding flanges and said clamping flanges each have a substantially circular shape.

12. The press according to claim 8, wherein:

said container has a longitudinal axis;

said holding flanges are fastened to said interior of said container;

said container has a juice discharge side;

at least one of said clamping flanges at a side of said container approximately opposite said juice discharge side has an approximately oval shape with a longer axis and a shorter axis; and when said drainage elements are inserted in said container, said shorter axis runs substantially parallel to said longitudinal axis of said container.

13. The press according to claim 12, wherein:

said clamping flanges and at least one of said holding flanges at said opposite side each have an approximately oval shape; and at least one of said clamping flanges and at least one of said holding flanges at said opposite side have a bayonet connector and are respectively connected to one another with said bayonet connector.

14. The press according to claim 1, wherein said supporting element is at least one of an elastic supporting element and a flexible supporting element.

15. The press according to claim 1, wherein said supporting element is at least two flexible supporting hoses.

16. The press according to claim 7, wherein said supporting element is at least two flexible supporting hoses fastened to said clamping pieces.

17. The press according to claim 16, wherein said supporting hoses are connected to said clamping pieces through crimped connections.

18. The press according to claim 1, wherein said supporting element is selected from one of the group consisting of a bar and a rod.

19. The press according to claim 1, wherein said container rotates about a horizontal axis.

20. The press according to claim 1, wherein said drainage elements are disposed over a diameter of said container and are substantially perpendicularly to a longitudinal axis of said container.

21. The press according to claim 1, wherein:

said container has a juice-extraction position; and said drainage elements are disposed substantially vertically in said juice extraction position.

22. The press according to claim 1, wherein said juice discharge is opposite said filling and emptying orifice.

23. The press according to claim 1, wherein said juice-permeable hose is of fabric.

24. The press according to claim 1, wherein said juice-permeable hose is one of a wound spiral and netting.

25. The press according to claim 1, wherein said container is at least one of an agricultural product container and a chemical product container.

26. The press according to claim 1, wherein said drainage elements are fluidically connected to said discharge.

27. A press for expressing liquid-containing substances, comprising:

a container having:

a filling and emptying orifice;

a cover selectively opening and water-tightly closing said filling and emptying orifice;

a water-tight casing defining an interior; and at least one press diaphragm disposed in said interior, said press diaphragm subdividing said interior into a pressure medium space and a press medium space;

a juice discharge fluidically connected to said press medium space;

drainage elements:

disposed in said interior;

each of said drainage elements being fluidically connected to said discharge; and each of said drainage elements having:

at least one supporting element being at least one of flexible and elastic;

a hose disposed around said supporting element, said hose being of a juice-permeable material and having opposing ends; and at least one holding device disposed at each of said ends of said hose and removably and releasably securing said drainage elements to holding flange disposed in said interior of said container;

each of said drainage elements being inserted into and removed from said interior of said container in one-piece.

28. A press for expressing liquid-containing substances, comprising:

a closed container having:

a cover;

a filling and emptying orifice selectively opened and closed by said cover;

a casing defining an interior; and at least one press diaphragm disposed in said interior;

said press diaphragm subdividing said interior into a pressure medium space and a press medium space;

a juice discharge associated with said filling and emptying orifice;

drainage elements disposed in said interior of said casing for large-volume juice extraction, said drainage elements being liquid-permeable and at least one of flexible and elastic and each of said drainage elements having:

at least one supporting element;

a hose disposed around said supporting element, said hose being of a juice-permeable material and having opposing ends; and holding devices disposed at each of said ends of said hose;

said drainage elements being a unitary assembly; and said holding devices removably and releasably securing said drainage elements to holding flanges disposed at said container, said drainage elements being inserted into and removed from said interior of said container as a structural part.

* * * * *